United States Patent [19]

Kern

[11] 4,102,233

[45] Jul. 25, 1978

[54] UPRIGHT HARPSICHORD ACTION

[76] Inventor: Evan J. Kern, 434 W. Main St., Kutztown, Pa. 19530

[21] Appl. No.: 813,439

[22] Filed: Jul. 7, 1977

[51] Int. Cl.[2] ..... G10C 1/06

[52] U.S. Cl. ..... 84/258

[58] Field of Search ..... 84/258, 320, 321

[56] References Cited

U.S. PATENT DOCUMENTS

| | | | |
|---|---|---|---|
| 382,028 | 5/1888 | Caldera | 84/258 |
| 394,467 | 12/1888 | Dietz | 84/258 |
| 694,589 | 3/1902 | Van Nette | 84/258 |

FOREIGN PATENT DOCUMENTS

| | | | |
|---|---|---|---|
| 23,937 | 10/1883 | Fed. Rep. of Germany | 84/258 |
| 10,231 of | 1886 | United Kingdom | 84/258 |

*Primary Examiner*—Lawrence R. Franklin
*Attorney, Agent, or Firm*—Howson and Howson

[57] ABSTRACT

A harpsichord action characterized by a vertical disposition of the strings which extend downwardly from a wrest plank located slightly above the keyboard. The keys, which are half the conventional length and hinged at their inner ends, are connected with jack levers located above the keys and in front of the strings. The jack levers are connected with jacks which are pulled forwardly by the jack levers upon depression of the keys. Each rank of jacks is controlled by a single jack guide which is selectively shifted by a cam mechanism operable from the keyboard.

18 Claims, 9 Drawing Figures

UPRIGHT HARPSICHORD ACTION

BACKGROUND OF THE INVENTION

The present invention relates generally to harpsichords and more specifically to a novel upright harpsichord action which permits the construction of a compact, lightweight and inexpensive instrument.

Aside from its substantial cost, the principal factor mitigating against the widespread use of the harpsichord is the considerable size of the conventional instrument which is comparable to that of a grand piano. Since the prospective harpsichord buyer would typically own a piano, space considerations are particularly important, especially in the case of small homes and apartments.

Efforts to reduce the size of the harpsichord have for the most part retained the main space consuming feature of the conventional instrument, the horizontal disposition of the strings. An exception was the clavicytherium developed in the 16th century wherein the strings extended vertically upwardly from a wrest plank located above the keyboard. The keys extended beneath the wrest plank and actuated jack levers behind the wrest plank and strings which in turn actuated the jacks. Although the clavicytherium required less floor space than the conventional harpsichord, its unusual height and awkward appearance by contemporary design standards would prevent its acceptance as a space saving alternative.

SUMMARY OF THE INVENTION

The present invention provides a novel harpsichord action which permits the strings to extend vertically downwardly from a wrest plank located slightly above the keyboard, resulting in a compact, inexpensive instrument of a size similar to that of a spinet piano. The keys are half the length of conventional keys and are hinged at their inner ends in front of the strings. Jack levers pivotally mounted above the keys in front of the strings include forwardly extending arm portions connected to the keys, and upwardly extending arm portions connected to one or more ranks of jacks by means of universal type connectors. Depression of the keys accordingly produces a rotation of the jack levers and a pulling of the jacks forwardly past the strings to produce a plucking of the strings. The jacks are aligned by a single jack guide for each rank of jacks disposed behind the strings and by their connection with the jack levers in front of the strings. Each jack guide may be selectively shifted by a cam mechanism operable from the keyboard to engage or disengage the ranks of jacks.

It is accordingly a first object of the present invention to provide a novel harpsichord action characterized by a vertical disposition of the strings which permits the construction of a compact harpsichord.

Another object of the invention is to provide a harpsichord action as described which can be readily adjusted to provide the desired keyboard touch and uniformity of response.

A further object of the invention is to provide a harpsichord action as described which is of a relatively simple construction and accordingly can be inexpensively manufactured.

Additional objects and advantages of the invention will be more readily apparent from the following description of an embodiment thereof.

DESCRIPTION OF THE PREFERRED EMBODIMENT

Figure 1:
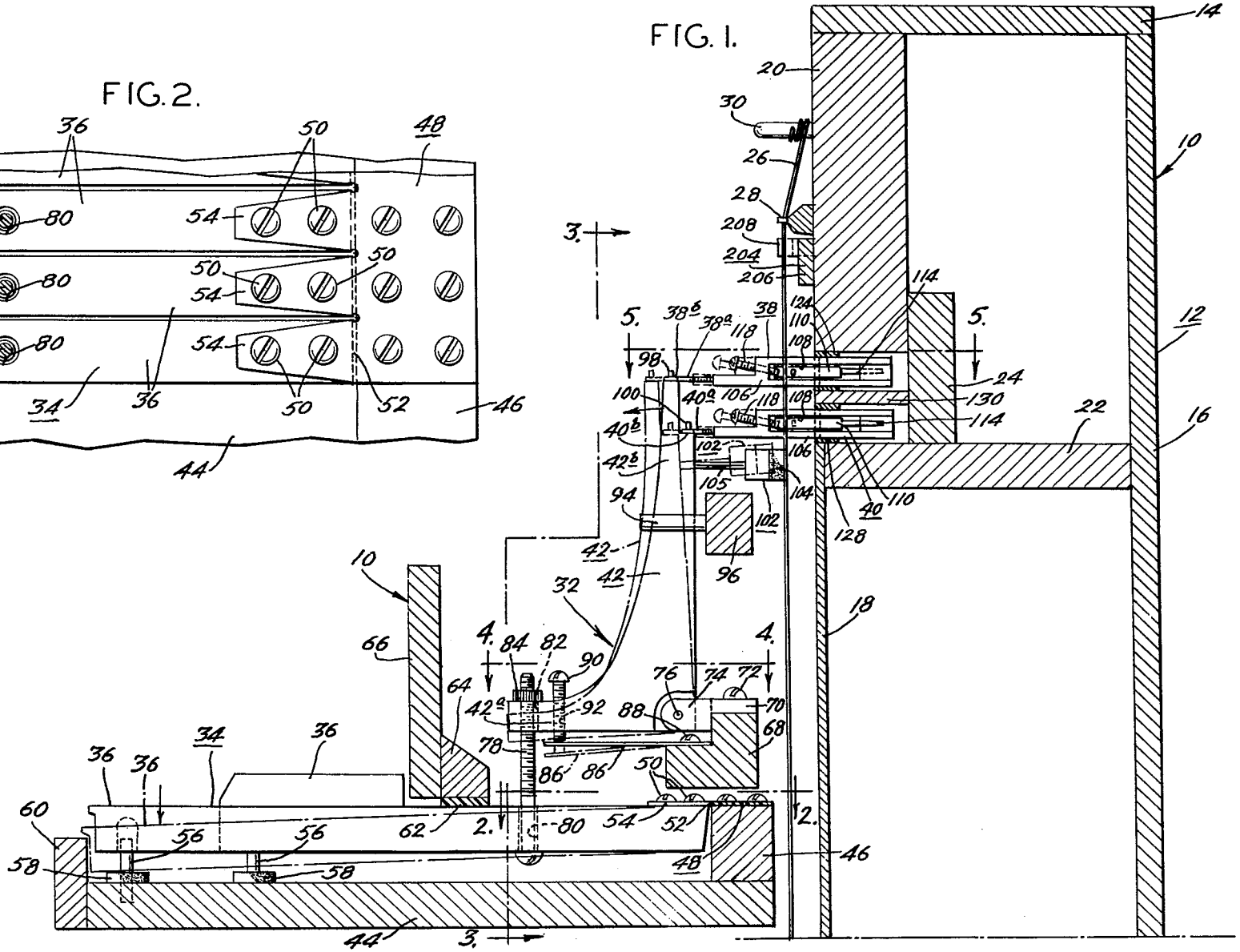
FIG. 1 is a partial side elevational view partly in section of a harpsichord incorporating an action in accordance with the present invention and showing in broken lines the resulting position of the related action components upon depression of a key.

Referring to the drawings and particularly FIG. 1 thereof, a harpsichord generally designated 10 having an action embodying the present invention is illustrated and includes a frame assembly 12 comprising essentially a plurality of longitudinal members extending between the upstanding ends (not shown) of the instrument. The frame assembly 12 as illustrated in FIG. 1 includes top and back panels 14 and 16 respectively, a sounding board 18 extending vertically in spaced relation from the back panel 16, and a wrest plank 20 disposed above the sounding board and immediately beneath the top panel 14. A horizontal frame member 22 extends between the back panel 16 and the sounding board 18 and a vertical frame member 24 extends between frame member 22 and the back of the wrest plank 20.

An array of strings 26 extending vertically in front of and in spaced relation to the sounding board 18 is supported by the frame assembly 12, the upper ends of the strings passing over a bridge 28 of the wrest plank 20 and being attached to tuning pins 30 in the wrest plank which permit adjustment of the string tension. The lower ends of the strings are attached to a lower frame member (not shown) in a conventional manner.

The strings 26 are respectively plucked by means of the harpsichord action which includes essentially three groups of components: a keyboard 34 at the front of the instrument comprising a plurality of keys 36; one or more ranks of jacks, in the present embodiment comprising upper and lower jacks 38 and 40 respectively actuated by each key 36; and a set of jack levers, each jack lever 42 providing an operative connection between a key 36 and its corresponding jacks 38 and 40. An important feature of the present invention is the location of the major part of the action 32 including the entire keyboard and jack lever mechanisms entirely in front of the strings 26 with only the rear portion of the jacks and the jack guide assemblies being located behind the strings. The strings may accordingly extend from above the action toward the floor which permits a compact instrument design.

Figure 2:
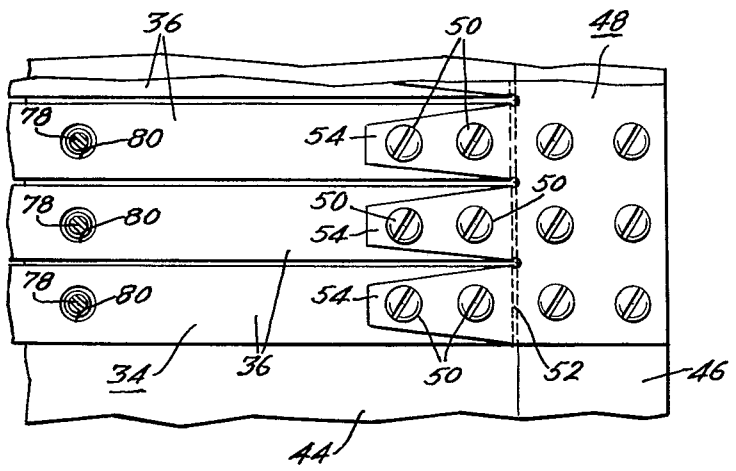
FIG. 2 is an enlarged partial plan view partly in section taken along line 2—2 of FIG. 1 showing details of the hinge attaching the keys to the key rail.

Considering the details of the action elements, the keyboard 34 is supported on a horizontal panel 44 of the frame assembly 12 which includes an upstanding key rail 46 along the rear edge thereof. The keys 36, which are arranged in the usual white and black pattern for whole notes and accidentals are considerably shorter in length than the conventional harpsichord keys, being essentially half-keys, and are hinged at their inner ends by attachment to a flexible serrated continuous plastic hinge strip 48 by screws 50 as shown in the enlarged plan view of FIG. 2. The serrations in the hinge strip 48 extend to the hinge axis 52, thereby defining a plurality of hinge fingers 54 corresponding in number to the number of keys 36. The keys 36 are maintained in parallel alignment by the conventional front rail pins 56, and their associated felt punchings 58 limit the downward travel of the keys. A cover panel 60 is provided at the front edge of the panel 44 and may be demountable to provide access beneath the keys for cleaning and maintenance. The upward return movement of the keys is arrested by engagement of the keys with the resilient pad 62 of the stop member 64 attached to the vertical frame member 66.

The jack levers 42 are pivotally connected to a jack lever rail 68 of the frame assembly 12, each jack lever being connected thereto by a bracket 70 attached to the rail by screws 72 and including a forwardly extending slotted portion 74 which slidably receives the corner of the jack lever and is pivotally connected thereto by the pivot pin 76. Each jack lever is vertically aligned with a key 36 and is connected thereto by means of a threaded jack lever rod 78 which passes freely through an oversize bore 80 in the key and a slot 82 in a forwardly extending arm portion **42*a* of the jack lever. The connection between each jack lever and its corresponding key can be adjusted by means of the knurled jack lever rod nut 84**.

Each jack lever 42 is biased in a clockwise direction as viewed in FIG. 1 by a leaf spring 86 attached to the jack lever rail 68 by a screw 88 and bearing against the lower end of a tension adjusting screw 90 passing vertically through a threaded bore 92 in the arm portion **42*a* of the jack lever. The spring 86, in view of the connection between the jack lever and the key provided by the jack lever rod 78, provides the restoring force necessary to return the key, jack lever and jack to its normal rest position. The adjusting screw 90** controls the "touch" of the key (the pressure required to depress the key).

Figure 3:
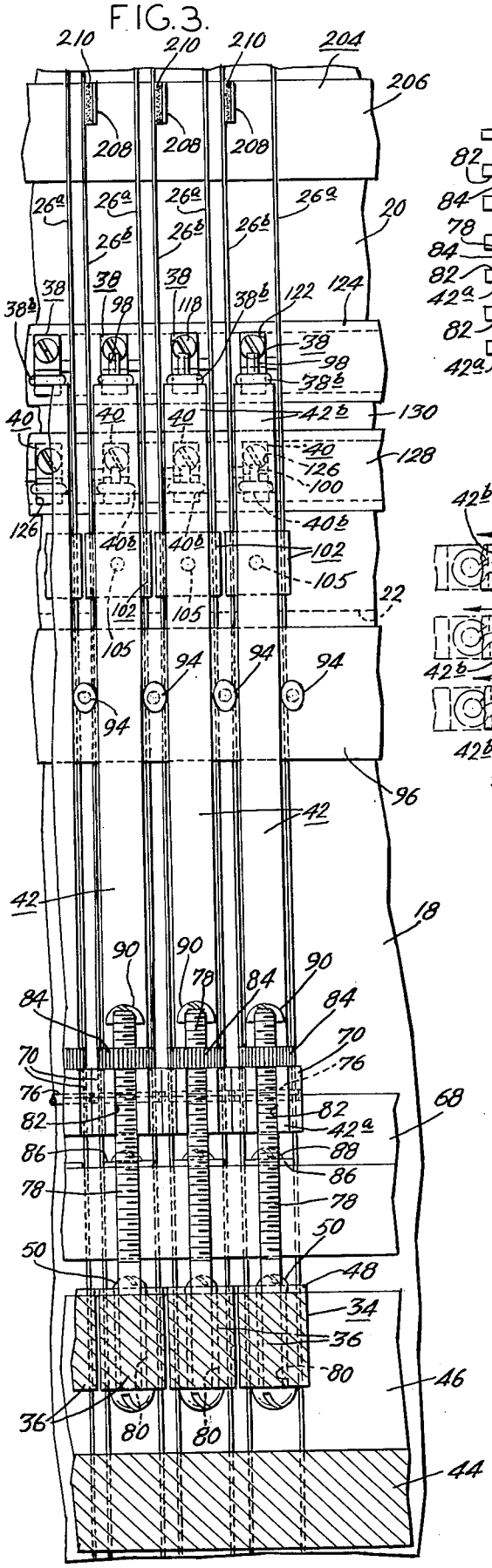
FIG. 3 is an enlarged partial front elevational view partly in section taken along line 3—3 of FIG. 1.
Figure 4:
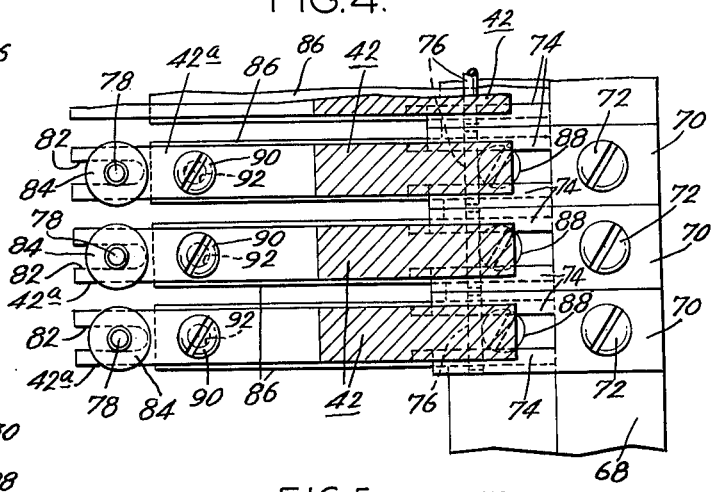
FIG. 4 is an enlarged partial plan view partly in section taken along line 4—4 of FIG. 1 showing details of the jack levers.

Each jack lever 42 includes an upwardly extending arm portion **42*b* which passes between guide pins 94 extending from guide pin rail 96 which is part of the frame assembly 12. The guide pins 94 as shown in FIG. 3 are preferably of an elliptical cross sectional shape so that rotation of the pins provides adjustment of the spacing between the pins. This arrangement permits the jack levers to be initially set up in close fitting but freely sliding relation with the pins 94** and further allows adjustment to be made should the engaging surfaces become worn.

The jacks 38 and 40, which are of a conventional construction as described below, are connected to the upwardly extending arm portion **42*b* of the jack lever 42 by means of threaded jack connectors 38*a* and 40*a* respectively. As shown most clearly in FIG. 5, the jack connectors include eye portions 38*b* and 40*b* which fit over round upper and lower jack lever studs 98 and 100 respectively. The upper jack lever stud 98 extends vertically from the upper end of the jack lever arm portion 42*b* while the lower jack lever stud 100 extends vertically from a shoulder formed by a setback in the jack lever arm portion 42*b*. The studs 98 and 100 are respectively aligned horizontally with the jacks 38 and 40, and fit easily within the connector eyes 38*a* and 40*b* to form a universal type connection permitting rotary movement of the jack lever about its axis 76 while accommodating essentially planar movement of the jacks without binding. The universal connection of the jacks and jack levers further permit a horizontal rotation of the jacks upon lateral shifting of the jack guides as described herebelow. The position of the jacks with respect to the strings may be adjusted by rotation of the threaded connectors 38*a* and 40*a***.

A damper 102 including a felt pad 104 adapted to engage the strings 26 when the action is in the rest position extends rearwardly on a damper rod 105 from the upper arm portion **42*b*** of each jack lever.

The jacks 38 and 40 are of an identical, conventional construction, each including an elongated rectangular-sectioned body 106 having a hollow elongated slot 108 therein within which a tongue 110 is pivotally mounted about a vertical pivot pin 112. An extending resilient tail portion 114 of the tongue 110 bears against a portion of the body 106 and serves as a spring tending to restore the tongue to the position illustrated in FIG. 5 with a beveled forward end 116 thereof in engagement with an adjusting screw 118 which extends rearwardly through a threaded bore of the body into the slot 108. A plectrum 120 extends laterally from the tongue 110 beyond the side of the body 106 and serves to pluck one of the strings 26 when the jack is moved forwardly past the string. The outer end of the plectrum is beveled on its rear face and on the return stroke of the jack serves to direct the tongue inwardly against the spring force of the tail portion 114 as the plectrum again engages the string. The plectrum will accordingly lightly brush against the string on the return stroke but without plucking the string.

Figure 5:
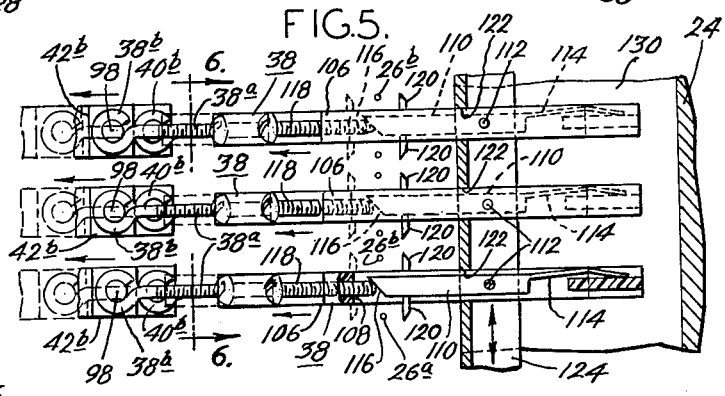
FIG. 5 is an enlarged partial plan view partly in section taken along line 5—5 of FIG. 1 showing details of the jacks.

In the present instrument, a pair of the strings 26 are plucked by downward movement of each key, one of the strings **26*a* being plucked by the upper jack 38 and the other string 26*b* by the lower jack 40. The jacks pass between the strings 26*a* and 26*b* and as shown in FIGS. 1, 3 and 5, the plectrum of the upper jack 38 extends to the right as viewed from the front of the instrument to pluck the righthand string of the pair between which the jacks travel, while the plectrum of the lower jack 40 extends to the left to pluck the lefthand string of the pair. The tongue of the lower jack 40 is accordingly reversed in its jack body so as to operate in the same manner but in the opposite direction as that of upper jack 38. As shown in FIG. 3, the damper 102** is sufficiently wide as to engage and dampen the vibration of both of the strings associated with its jack lever.

Figure 6:
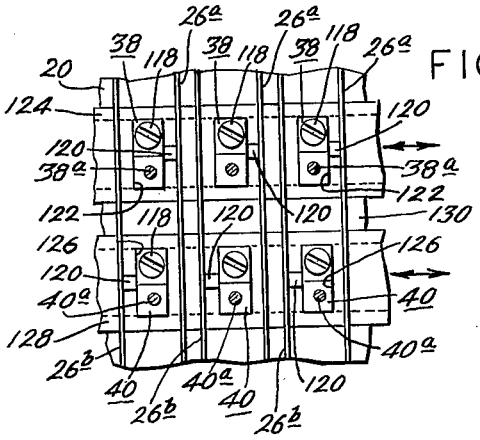
FIG. 6 is a partial view partly in section taken along line 6—6 of FIG. 5 showing details of the jack guides.

The upper rank of jacks 38 pass through rectangular apertures 122 in a horizontally extending upper jack guide 124 which has a channel shaped sectional configuration. Similarly, the lower rank of jacks 40 pass through rectangular apertures 126 in a lower jack guide 128. The jack guides serve in conjunction with the jack lever studs to position the jacks to properly pluck the strings when the keys are depressed in one position of the jack guide, or to miss the strings entirely when the keys are depressed in a second position of the guide when the plucking of one of the sets of strings is not desired. As indicated in FIGS. 5 and 6, the jack guides 124 and 128 move horizontally, the upper jack guide 124 being moved to the left as viewed from the front of the instrument (FIG. 6) to silence the strings 26*a* plucked by the upper jacks 38, while the lower jack guide 128 is moved to the right to remove the lower jacks 40 from engagement with the other set of strings 26*b*. Obviously, both ranks of jacks would not be disengaged from their strings at the same time since to do so would result in no tone at all being produced from the depression of the keys.

Figure 7:
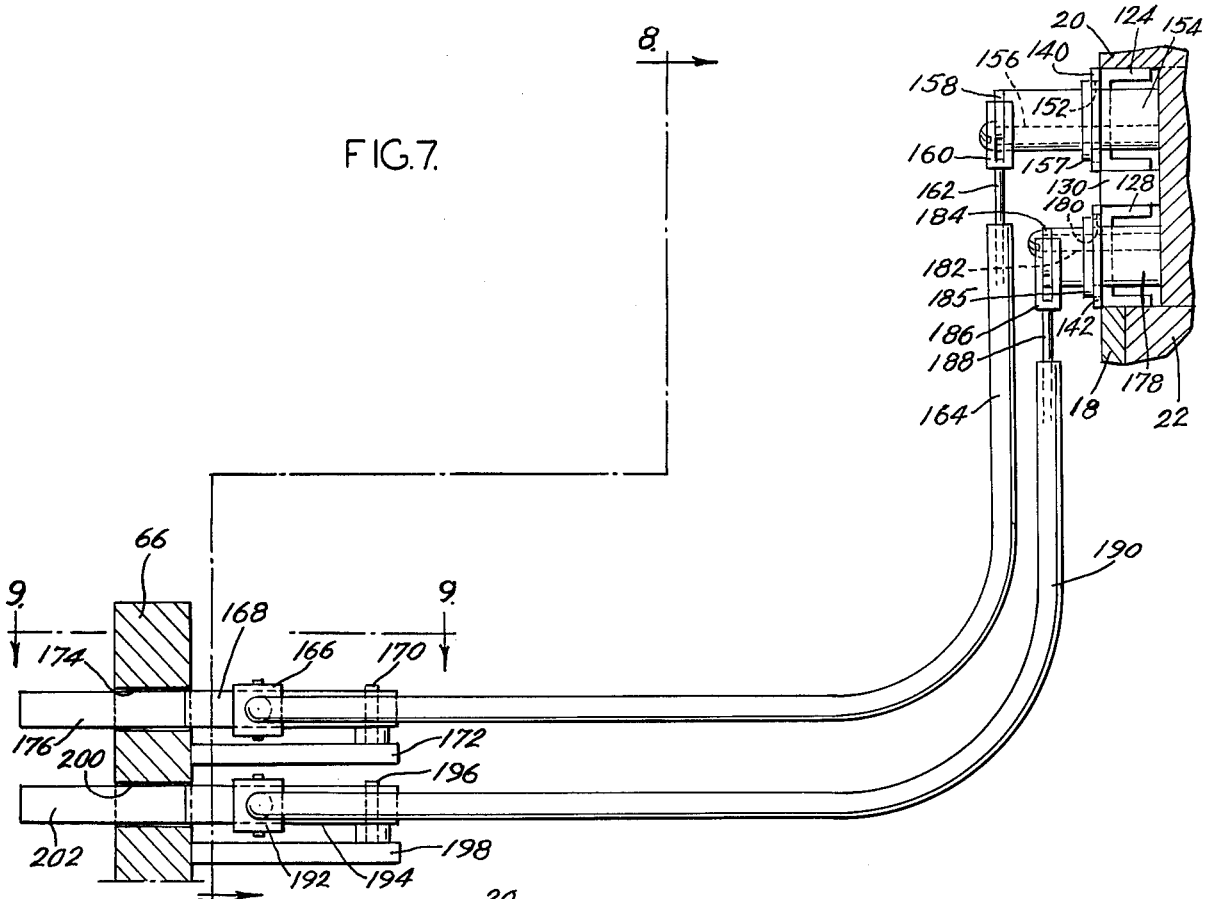
FIG. 7 is a partial side elevational view partly in section of a jack guide control mechanism in accordance with the present invention, parts of the harpsichord action being omitted for clarity.
Figure 8:
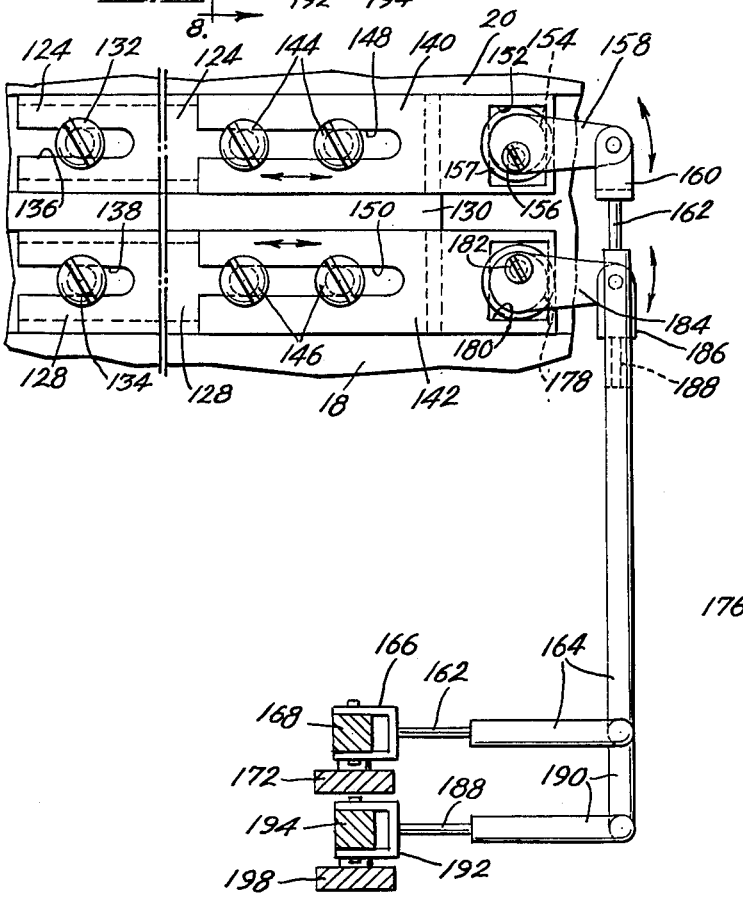
FIG. 8 is a partial front elevational view partly in section taken along line 8—8 of FIG. 7.
Figure 9:
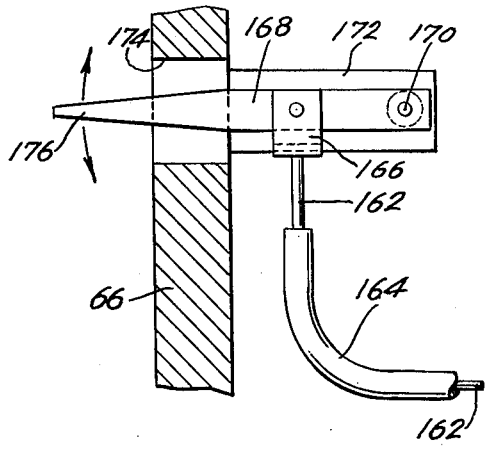
FIG. 9 is a partial plan view partly in section taken along line 9—9 of FIG. 7.

The mechanism employed for the shifting of the jack guides 124 and 128 is illustrated in FIGS. 7–9. From FIG. 8 as well as FIG. 1, it can be seen that the jack guides 124 and 128 are separated by an intermediate frame member 130 so that the upper jack guide 124 is slidably disposed between the wrest plank 20 and the frame member 130, which the lower jack guide 128 is slidably disposed between the frame member 130 and the upper end of the sounding board 18 and a portion of the frame member 22. At their lefthand ends as viewed from the front of the instrument and as shown in FIG. 8, the jack guides are slidably retained by screws 132 and 134 cooperating with slots 136 and 138 respectively in the jack guides 124 and 128. At their righthand ends, the jack guides 124 and 128 are respectively provided with cam follower plates 140 and 142 secured thereto by screws 144 and 146 adjustable within slots 148 and 150.

The cam follower plate 140 is provided in a portion thereof extending beyond the end of the jack guide 124 with a rectangular hole 152 for receiving a cylindrical cam 154 which is mounted for rotation on a pivot screw 156 extending through an eccentrically located bore therewithin and fastened into the frame member behind the jack guide. An annular flange 157 on the cam 154 prevents forward movement of the jack guide. A crank arm 158 extends radially from the outer end of the cam 154 and is pivotally connected at its outer end to a clevis 160 attached to a flexible cable 162 passing through rigid tube 164 which is secured to the harpsichord frame assembly by means not shown. The other end of the cable 162 is attached by means of clevis 166 to a control lever 168 pivotally mounted by a pin 170 to a support arm 172 extending from the rear of the frame panel member 66 above and at one end of the keyboard. The lever 168 extends through an opening 174 in the panel 66 and the outer end 176 thereof extends beyond the panel 66 for selective movement as indicated in FIG. 9. Movement of the control lever 168 to the left as viewed from the front of the instrument will move the crank arm 158 downwardly and hence rotate the cam 154 clockwise about its pivot screw 156. Since the screw 156 is eccentrically located with respect to the cylindrical cam 154, and since it is located below the center of the cam 154, clockwise rotation of the cam will result in a movement of the cam follower plate 140 and the attached jack guide 124 to the right as viewed from the front of the instrument (FIG. 8). Since as shown in FIG. 3 the plectra of the upper jacks 38 extend to the right as viewed from the front of the instrument (FIG. 3), the movement of the control lever 168 to the left will shift the upper jacks 38 into position to engage and pluck the strings 26*a* upon the depression of the corresponding keys.

Conversely, the movement of the control lever 168 to the right as viewed from the front of the instrument will produce an upward movement of the crank arm 158 and a counterclockwise rotation of the cam 154, thereby resulting in a leftward movement of the cam follower 140 and jack guide 124 and a positioning of the upper jacks 38 so as to prevent the plectra thereof from touching the strings 26*a* upon depression of the keys.

In a manner virtually identical to that described with respect to the upper jack guides 124 and cam follower plate 140, the lower jack guide 128 and cam follower plate 142 are laterally positioned by means of a cylindrical cam 178 extending through a rectangular aperture 180 in the cam follower plate 142, the cam being rotatable about a pivot screw 182 attached to the frame assembly. An annular flange 185 on the cam 178 retains the jack guide in position. A crank arm 184 is connected by a clevis 186 to flexible cable 188 passing through the rigid tube 190 affixed to the frame assembly. The opposite end of the flexible cable 188 is connected by clevis 192 to a control lever 194 which is pivotally supported by pivot pin 196 on support arm 198 located directly below the support arm 172. An aperture 200 in the frame member 66 below the aperture 174 permits passage of the control lever 194 and an extending end 202 thereof is operable from the keyboard side of the panel member 66 as illustrated in FIG. 7. The pivot pin 182 as shown in FIG. 8 is eccentrically located above the axis of the cylindrical cam 178 and accordingly the movement of the control lever 194 to the left will result in a downward movement of the crank 184 and a leftward movement of the cam follower plate 142 and jack guide 128. However, since the plectra of the lower jack 40 extends from the lefthand side of the jacks (FIG. 3) the leftward movement of the control lever 194 will move the jacks 40 to the left and into engagement with the strings 26*b* when the keys are depressed. Conversely, a rightward movement of the control lever 194 will move the jacks 40 to the right and prevents engagement of the jacks with the strings 26*b* upon depression of the keys. The control levers 168 and 194 accordingly each work in the same manner, engaging the corresponding rank of jacks when the lever is moved to the left and disengaging the jacks when the lever is moved to the right.

To provide a further selective modulation of the tone of the instrument, a harp stop assembly 204 is provided which includes a longitudinally extending slidable batten 206 disposed adjacent the wrest plank 20 immediately below and parallel to the bridge 28. As shown in FIGS. 1 and 3, thin metal tabs 208 protruding from the batten 206 each include a dampening pad 210 for engagement with the side of a string. The tabs can be bent to one side or the other to adjust the degree of contact of the pads with the strings. In the illustrated embodiment, the tabs 208 are provided only adjacent the strings 26*b* and accordingly the harp stop will affect only the tonal qualities of the strings plucked by the lower jacks 40. The guide means and the means for selectively engaging the harp stop with the strings are not shown but are preferably of a similar construction to the arrangements illustrated and described above for providing selective lateral movement of the jack guides. Although the present harp stop is operable only with respect to the strings 26*b*, a second harp stop could be provided for use with the strings 26*a*.

The operation of the instrument is conventional, the performer playing the keys 26 in the usual manner. The tonal qualities of the instrument can be varied as desired by selecting a combination of the upper and lower ranks of jacks with or without the harp stop, the upper rank of jacks alone, or the lower rank of jacks alone with or without the harp stop. There are accordingly five possible stop combinations of the instrument illustrated.

The operating details of the action should be apparent from the above description and will accordingly be only briefly summarized. The depression of a key 36 as viewed in FIG. 1 moves the jack lever 42 connected therewith by the jack lever rod 78 in a counterclockwise direction, the motion being limited by the engagement of the key with the punching 58. The rotation of the jack lever 42 simultaneously removes the damper 102 from the strings and moves both of the connected jacks 38 and 40 forwardly a distance sufficient to move the plectrum of each jack past the string associated therewith. Depending upon the position of the control levers 168 and 194, the plectrum of each jack will either pluck the associated string or pass by the string without contacting the string. Upon release of the key, the spring 86 returns the key, jack lever and jack to the initial rest position, the return movement being limited by the engagement of the key with the pad 62 of stop member 64. During the return movement of the jacks, the strings are not plucked in view of the pivotal movement of the jack tongues which allows the plectra to graze rather than pluck the strings on their return. As the key approaches the rest position against the pad 62, the damper pad 104 engages the strings to dampen any residual string vibrations.

Additional ranks of jacks could be added to the illustrated embodiment by adding further shoulders to the jack levers and adding additional sets of jack guides and guide shifting mechanisms. Similarly, a further harp stop could be added to vary the tonal quality of strings 26*a*.

From the foregoing description, it will be apparent that the objects of the invention have been realized. The vertical disposition of the strings and the shortened length of the keys permit a very compact construction resulting in a small, lightweight instrument that takes up little floor space and can easily be lifted and moved by two people. The simplicity of the action should permit manufacture at a relatively low cost. The ease of adjustment of the key-jack lever connection by means of the nut 84 as well as the force of spring 86 by means of screw 90 permits a uniform adjustment of the action to the desired touch.

Manifestly, changes in the details of construction can be effected by those skilled in the art without departing from the spirit and scope of the invention.

I claim:

1. A harpsichord action comprising a frame assembly, a string supported vertically in tension by said frame assembly, a key disposed substantially horizontally and hingedly attached at its rear end to said frame assembly at a point in front of said string, a jack lever disposed above said key in vertical alignment therewith and pivotally attached to said frame assembly, said string being disposed in substantial alignment with said key and jack lever and extending from a point above and behind said jack lever and key to a point therebelow, a jack connected to said jack lever, a jack guide behind said string adapted to support said jack for sliding movement toward and away from said string, said jack having a plectrum adapted to engage and pluck said string, the depression of said key producing a rotation of said jack lever and a movement of said jack and plectrum toward said string to produce a plucking of said string.

2. The invention as claimed in claim 1 including means for restoring said key, jack lever and jack to its rest position upon release of said key.

3. The invention as claimed in claim 2 wherein said restoring means comprises an adjustable spring.

4. The invention as claimed in claim 1 wherein said jack lever and key are connected at points substantially forward of their hinge points.

5. The invention as claimed in claim 1 wherein said jack lever is connected to said jack by a universal connector.

6. The invention as claimed in claim 1 including a damper attached to said jack lever having a resilient pad thereon and adapted to engage said string in the rest position of the action and to move away from said string when said key is depressed.

7. An upright harpsichord comprising a frame assembly, a keyboard comprising a plurality of keys each hingedly mounted at the inner end thereof to said frame assembly, a plurality of jack levers pivotally attached to said frame assembly, each said jack lever being disposed above an underlying key in vertical planar alignment therewith, means connecting each said key to the corresponding aligned jack lever whereby depression of each said key produces rotary movement of the corresponding jack lever, said frame assembly including string support means for supporting a substantially vertical array of parallel strings in tension, said strings each extending from a point above and behind said jack levers and keys to a point therebelow, at least one string being disposed in substantial alignment with each said key and jack lever, a jack guide extending horizontally behind said array of strings, each said jack lever having a jack connected thereto and supported by said jack guide for sliding movement toward and away from the string aligned therewith, each said jack including a plectrum adapted to engage and pluck said aligned string, the selective depression of the keys producing a rotation of the corresponding jack levers and a sliding movement of the jacks connected thereto to provide a selective plucking of the strings.

8. The invention as claimed in claim 7 including means for restoring each said key, jack lever and jack to its rest position upon release of each said key.

9. The invention as claimed in claim 8 wherein said restoring means comprises an adjustable spring associated with each said jack lever.

10. The invention as claimed in claim 7 wherein each said jack lever and corresponding key are connected at points substantially forward of their hinge points.

11. The invention as claimed in claim 10 wherein the connection between each said key and jack lever comprises an adjustable threaded jack lever rod and nut.

12. The invention as claimed in claim 7 wherein each said jack lever is connected to its jack by a universal connector.

13. The invention as claimed in claim 7 including a damper attached to each said jack lever having a resilient pad thereon and adapted to engage the aligned string in the rest position of the corresponding key and to move away from said string when said key is depressed.

14. The invention as claimed in claim 7 wherein a plurality of jacks are connected to each said jack lever and including a plurality of jack guides equal in number to the number of jacks per jack lever, each jack guide supporting and aligning a separate rank of jacks.

15. The invention as claimed in claim 14 including means for selectively shifting said jack guides to move the jacks associated therewith laterally toward or away from the adjacent strings.

16. The invention as claimed in claim 15 wherein said means for shifting each said jack guide comprises a cam pivotally attached to said frame assembly, a cam follower attached to said jack guide, and means for selectively rotating said cam remotely from said keyboard.

17. The invention as claimed in claim 7 including a harp stop comprising a batten adjacent said strings, tabs extending from said batten in spaced relation corresponding to the spacing of said strings, a dampening pad on each said tabe adapted to engage one of said strings, and means for selectively moving said batten to engage or disengage said tab pads with said strings.

18. The invention as claimed in claim 17 wherein said keys are hingedly connected to said frame assembly by a serrated strip of flexible plastic material, the serrations of said strings defining a plurality of hinge fingers corresponding in number to the number of keys.

* * * * *